United States Patent [19]

Rogers

[11] Patent Number: 4,903,359

[45] Date of Patent: Feb. 27, 1990

[54] BODY SUPPORT FOAM PAD WITH ADAPTIVE SHEAR STRESS CONTROL

[76] Inventor: John E. Rogers, P.O. Box 1437, Blue Jay, Calif. 92317

[21] Appl. No.: 323,676

[22] Filed: Mar. 15, 1989

[51] Int. Cl.[4] ..... A47C 27/14; A61G 7/00

[52] U.S. Cl. ..... 5/464; 5/481

[58] Field of Search ..... 5/481, 464, 448, 420; 297/DIG. 1

[56] References Cited

U.S. PATENT DOCUMENTS

| | | | |
|---|---|---|---|
| 3,828,378 | 8/1974 | Flam | 5/481 |
| 4,042,987 | 8/1977 | Rogers | 5/464 |
| 4,686,724 | 8/1987 | Bradford | 5/481 |

FOREIGN PATENT DOCUMENTS

| | | | |
|---|---|---|---|
| 1559851 | 1/1980 | United Kingdom | 5/464 |

*Primary Examiner*—Alexander Grosz
*Attorney, Agent, or Firm*—Natan Epstein

[57] ABSTRACT

A body support mattress of compressible foam has a body supporting surface sliced to define an array of contiguous polygonal blocks each having a load bearing surface. The blocks are interconnected by foam links integral with the pad, and the foam links are individually rupturable under load to adapt to the support requirements of particular users and relieve shear stress on a body resting on the mattress.

15 Claims, 1 Drawing Sheet

BODY SUPPORT FOAM PAD WITH ADAPTIVE SHEAR STRESS CONTROL

BACKGROUND OF THE INVENTION

1. Field of the Invention

The present invention relates generally to resilient pads, mattresses, and the like for supporting the human body and more particularly is directed to pads or mattresses made of foamed material and constructed so as to more evenly distribute the pressure on a body resting thereon than would be the case with a solid slab of foam material, with the object of minimizing pressure on the skin to avoid injury and in particular to prevent formation of decubitus ulcers, also known as bed sores.

2. Background of the Invention

A great deal of effort has been expended in the past in efforts to devise and improve mattresses and pads of various types so as to distribute as evenly as possible the pressure exerted on the body of a person resting theron. Given the irregular shape and weight distribution of the human body, when a person is laid down or sits upon a plane surface, however resilient that surface may be, there are areas of the body in contact with the supporting pad surface which will carry a disproportionate pressure load. In a bed-ridden person resting supine on a horizontal, uniform surface, areas of high local pressure are typically found at the back of the heels, the sacrum area, and the back of the head. In a side position, areas of peak pressure are typically found in the hip bone or trochanter area in contact with the supporting surface.

Protracted pressure against any portion of the skin has the effect of diminishing or cutting off peripheral vascular flow to that area. If impairment of blood flow to the affected area is sufficiently prolonged, the tissues underlying the affected skin area will be starved of nutrients and suffer progressive damage. Typically it is the underlying soft tissues which are first damaged, until eventually the skin undergoes necrosis and ulcerates in progressive manner, and unless the pressure on the area is removed, such ulcers can become deep open wounds which are difficult to treat and slow to heal.

Numerous advances and improvements have been made in the past to overcome this problem. One approach to resolving this difficulty has been to design and construct foamed material mattresses and pads which are modified so as to take into account and accommodate the areas of the body at which high pressure levels are typically encountered.

Towards this end, it is known in the prior art to provide foam pads and mattresses which are slit, cut or scored so as to modify the tensile force of the foam material at different locations across the supporting surface of the pad. Examples of this approach are disclosed in U.S. Pat. Nos. 3,828,378 to Flam and 4,110,881 to Thompson. Both of these prior patents disclose foam mattresses having a rectangular body supporting surface which is selectively cut to select depth in a rectangular grid pattern over particular areas of the supporting surface. The gridded score lines define individual columnar elements or blocks which are attached at their bottom to an uncut, interconnecting bottom layer of the pad thickness, typically contiguous to the under surface of the pad. These individual blocks are more easily compressible than an even, unscored supporting surface because the score lines have the effect of eliminating lateral tensile forces which normally act within an unscored pad when a point pressure is applied to its surface. The compressibility of such an uncut pad is a function of a combination of the vertical compressibility and the lateral tension in the foam material which tends to resist local compression of the material. The improved local compressibility of the individual blocks, for a given resilient pad material, is a function of the depth of cutting or scoring, i.e. vertical height of the individual block, and of the surface area of the individual blocks. Compressibility increases with depth of cut and is an inverse function of the block surface area. Consequently, as described in the cited prior art patents, variations in firmness or compliance across the supporting surface of the foam pad may be achieved by scoring at least a portion of the pad surface and varying either or both the depth of scoring and the spacing between score lines in selected regions of the pad surface. The regions are normally selected so as to achieve a complementary relationship between pad compliance and pressure on particular areas of the body supported by the pad. Thus, it is appropriate to provide more compliant supporting regions underlying the head, hip or saccrum, and the feet and heel supporting portions of the foam pad. As described in the cited Flam reference, a pad can be rather closely tailored to empirically obtained body pressure curves so as to optimize weight distribution on the pad surface and thereby minimize pressure applied to any given portion of the patient's body.

SUMMARY OF THE INVENTION

It has been found useful and advantageous by this applicant to provide a third modality, not previously known, whereby the compliance of a resilient pad surface can be further locally modified and controlled, in addition to the variable scoring approach described above. The present invention further offers a means for better controlling shear stress at support surface discontinuities, such as at hole edges and transitions into surface depressions, cavities, and such.

According to the invention here disclosed, a body support pad of compressible foam having a supporting surface and substantially uniform thickness is improved in that at least a portion of the supporting surface is cut to a select depth lesser than the pad thickness in a pattern defining an array of contiguous polygonal blocks each having a load bearing surface and a number of corners extending normally to the surface into the pad. Each said block is connected at each corner to each other block immediately adjacent thereto by foam links integral with the pad. The foam links are adapted and configured to rupture in response to predetermined shear force applied to the load bearing surface of the particular block relative to any other adjacent blocks. As a result, the portion of the supporting surface which includes the block array is characterized by initially uniform load bearing characteristics through the block array, but is permanently adaptive to the support requirements of particular users for relieving shear stress on a body resting on the array surface by selective rupturing of individual foam links.

The individual blocks may have different load bearing surface shapes including but not limited to rectangular, hexagonal, or octagonal. The array pattern is made by discrete cuts into the supporting surface of the pad, the cut defining sides of each polygonal block, the cuts being discontinuous and defining integral foam links at common corners of adjacent blocks. It is preferred to make the discrete cuts in the form of slits in the foam which cutting does not remove a significant volume of foam between adjacent blocks. The foam links extend from the supporting surface into the pad thickness the full depth of the cuts defining the links. The select depth of the discrete cuts may be the greater part of the pad thickness so as to allow manual removal of any individual block within a given array by tearing the foam links and any remaining uncut thickness of the pad interconnecting said block to the remainder of said pad so as to create a cavity or a hole in the pad.

In one form of the improved support pad, the load bearing surface of individual blocks is smaller in regions of the supporting pad surface expected to carry heavier load forces per unit area, and a larger surface area for those blocks in other regions expected to carry relatively smaller load forces per unit are imposed by a human body resting thereon.

In another form of the invention, the selective depth of cutting varies across the supporting surface of the pad, the depth being greater for blocks to be more heavily loaded and lesser for blocks to be more lightly loaded by a human body resting on the supporting surface.

In still another form of the invention, the foam links vary in individual tearing strength, i.e. resistance to tearing, or tear resistance across said supporting surface. For example, the foam links vary in tearing strength inversely to the load bearing surface area, so that larger blocks are torn free and separated from adjacent blocks more readily than smaller surfaced blocks, for a given block height or depth of cut. Conversely, it may be found desirable to make the foam links diminish in tearing strength for a smaller block load bearing surface area, so that smaller blocks are torn free and separated from adjacent blocks more readily than larger surfaced blocks, again for a given block height or depth of cut.

The foam links may also vary in tearing strength inversely to the depth of cut, so as to compensate for the greater depth dimension of the foam links in deeper blocks and thus maintain, if desired, a common tearing force for blocks of different depth. These and other combinations of foam link tearing strength, block surface area and block depth provide enhanced flexibility for adapting the supporting surface of the pad to the needs of particular users without forcible resort to custom pad or cushion designs. The variations in tearing strength of the foam links are obtained for example, by varying the degree of discontinuity between the discrete cuts defining the foam links. A given pad can be provided with one or more arrays of interlinked blocks which then separate in a pattern determined by and responsive to the particular shape size and weight distribution of a particular user without need for prior customizing or intervention by attending personnel. The pad with interlinked block arrays is therefore permently adaptive to the support requirements of individuals users and is capable of providing inherent shear stress relief particularly around holes or cavities in the supporting surface of the foam pad.

DETAILED DESCRIPTION OF THE PREFERRED EMBODIMENTS

Figure 1:
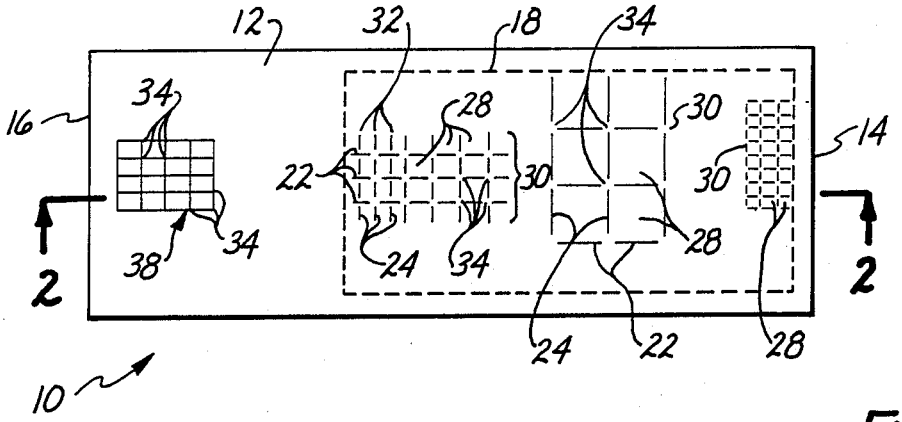
FIG. 1 is a plan view of a foam pad cut and scored according to the improvement of this invention.
Figure 2:
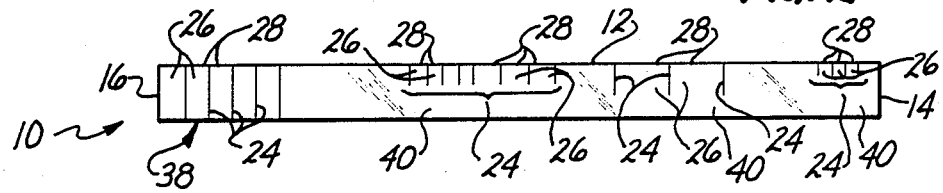
FIG. 2 is an elevational section taken along line 2—2 in FIG. 1 showing the variable depth cutting of the scored pad.

With reference to the drawings, FIGS. 1 and 2 show a rectangular pad 10 having an upper, body supporting surface 12 extending between a head end 14, foot end 16 and two sides 18. A portion 20 of the supporting surface 12, contained within the delineated rectangle designated by the numeral 20, has been cut and scored in a rectangular grid pattern, including parallel longitudinal cuts 22 and parallel transverse cuts 24. In FIG. 1 it will be seen that in the surface portion 20 three regions or block arrays can be identified, each having different spacing between the parallel cuts 22, 24 and consequently defining rectangular blocks 26 of varying surface area 28. The arrangement and relative dimensions of the three block arrays in FIGS. 1 and 2 is by way of example only, and can be modified to suit any particular support objective.

Figure 3:
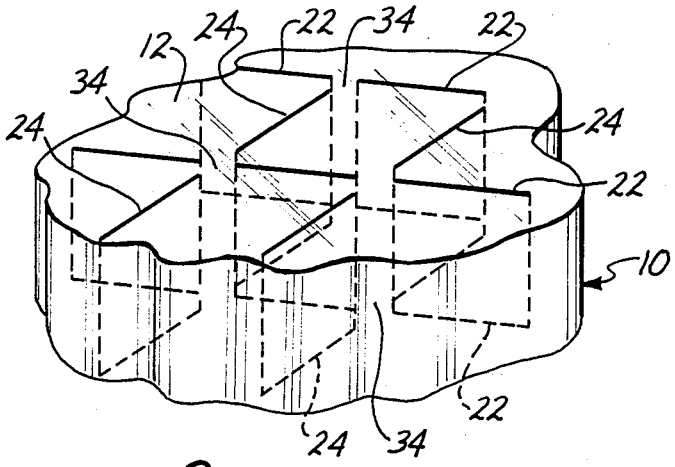
FIG. 3 is an enlarged perspective view of a pad fragment showing, partly in dotted lining, the discrete cutting pattern defining interlinked blocks in an array of the foam pad of FIG. 1.

The different block arrays are similar in that individual blocks 26 are divided and separated from adjacent blocks 26 along four sides defined by two longitudinal cuts 22 and two transverse cuts 24. The cuts 22 as well as the individual cuts 24 are arranged in discontinuous lines 30, 32 respectively, with the discontinuities being common to each intersection of the lines 30, 32 and thus defining at each discontinuity a link 34 of foam material integral to the pad 10. Each such link 34 interconnects the four corners of a rectangular block 26 to the corners of the immediately adjacent rectangular blocks 26 or to an uncut border or other portion of the foam pad 10. These foam links 34 extend vertically from the upper block surfaces 28 i.e. from the load bearing surface 12 of the pad 10, downwardly through the pad thickness to the full depth of the corresponding cuts 22, 24 as best appreciated by reference to FIG. 3. The discontinuities 34 defined by gaps between adjacent cuts 22 in longitudinal linear arrays 30 or cuts 24 in transverse linear arrays 32 may be of varying dimensions depending on the relative dimensions between the discontinuities and the length of the adjacent cuts 22, 24. Typically, it is contemplated that each discontinuity 34 comprise a relatively small portion of the length of the immediately adjacent cuts 22 or 24. This creates a significant yet rupturable foam link of predeterminable strength interconnecting the corners of adjacent blocks 26.

Figure 4:
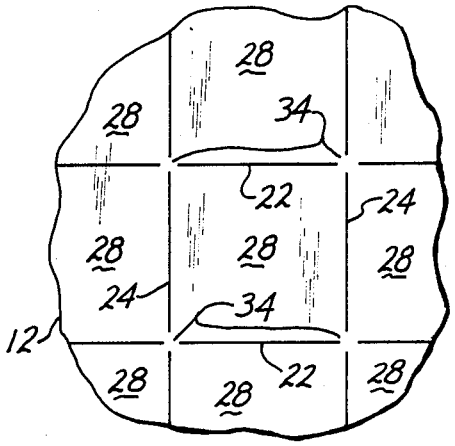
FIG. 4 is an enlarged fragmentary view of the an array of interlinked foam blocks such as in FIG. 3.

The usefulness of this interlinked block configuration lies in its adaptability to the requirements of particular individuals, given the wide variation in body shapes, weight and dimensions. For example, it is possible to configure the entire top surface 12 of the pad 10 in uniform sized blocks 26 of uniform load bearing surface 28 interconnected at all four corners by integral foam links 34 as shown, for example, in FIG. 4. In an initial condition of the pad, all blocks 26 are uniformly interconnected and the upper surface 12 of the pad 10 exhibits uniform support characteristics which can itself, i.e. the initial condition, be adapted to particular requirements by varying the length and depth of cuts 22, 24, the relative dimensions of the links 34 i.e., the relative dimensions of the discontinuities between adjacent cuts, among still other variables such as the ILD (indentation load deflection) value of the particular foam used in for the pad 10, which can vary widely and is an industry standardized measure of the fight-back force or compliance of the foam material.

In a foam pad cut into rectangular tuffs or blocks according to the prior art approach i.e. without any interconnection between the blocks, particularly no interconnection along the corner edges of the blocks as shown here, the support characteristics of the pad are fully determined from the start by the dimensions of the individual blocks and the foam ILD. In the pad 10 of the present invention, however, this is not the case. While the pad may be configured with initially uniform supporting characteristics across its entire surface 12, adaptation to the particular support requirements of a given patient or user takes place by tearing and rupturing of individual foam linkages 34 upon loading of the corresponding block surfaces 28 by the patient's body weight resting on the pad surface 12. This tearing of linkages 34 is selective and occurs in a pattern determined entirely by the weight distribution of the user's body over the surface 12. Wherever the load on a particularly block surface 28 exceeds the tearing strength of the corresponding links 34, that linkage 34 will tear, freeing the particular corner of the block 26 from linkage to the adjacent blocks 26. Rupture of each linkage 34 has the aforedescribed effect of separating the lateral or tensile forces within the array of blocks 26 and allows the compressibility of individually freed blocks 26 to be determined entirely by the dimensions of the block, i.e. height and side dimensions, and by the ILD of the foam material. The interlinked array of blocks 26 is therefore capable of adapting to particular pressure contours by yielding at areas of high pressure sufficient to rupture the links 34, thus providing more compliant pad regions corresponding to peak loading of the patient's body, typically at the aforementioned high pressure areas of the body such as hip bone, saccrum, heels and head. This yielding however, does not compromise the firmness and original support characteristics of other, still interlinked regions of the array of blocks 26.

The interlinking of adjacent blocks 26 along their vertical corner edges enables a further variation in the configuration of pad 10, namely foam blocks 26 which extend the full thickness of the pad 10, from the top surface 12 to the undersurface 36, as for example in the block array 38 in the head area of the pad 10, in FIGS. 1 and 2. The vertical cuts 24 as well as the cuts 22 defining the blocks 26 in array 38 extend the full thickness of the pad 10 such that the individual blocks elements 26 in array 38 are connected to the pad only by the corner links 34. Individual blocks 26 in array 38 may be readily removed entirely from the pad 10 by manually tearing away the interconnecting links 34 of selected blocks in the array so as to define an opening through the pad 10 of any desired shape, up to the full size of the array 38. This opening or hole would then extend through the full thickness of the pad 10. Such holes may be desirable for a particular patient at different locations of the pad 10, for example underneath existing decubitus ulcers. In such cases, it is best to avoid further contact of the ulcer with any supporting material in order to give the damaged skin an opportunity to heal. Appropriately sized and shaped openings can be made in the pad 10 for this purpose by manually tearing away individual block elements 26 and extracting them from the pad. This can be done with blocks 26 in an array such as array 38 which is cut through the full thickness of the pad, and also in arrays such as those in the pad portion 20, where the individual blocks 26 do not extend the full thickness of the pad and are interconnected at their lower ends by an integral, uncut layer 40 coextensive with those arrays of blocks 26 as indicated in FIG. 2. The thickness of the layer 40 can be made relatively small so as to allow any remaining, uncut thickness of foam to be torn out along with individual blocks 26, thus leaving a hole through the full thickness of the pad upon removal of individual blocks. It is also possible, in the alternative, to make the blocks 26 relatively small such as shown at the foot end of the pad in FIGS. 1 and 2; individual small blocks 26 can be torn away from an underlying uncut thickness 40 of the pad by simply tearing away the individual blocks both from the linkages 34 as well as the underlying layer 40. In this latter case, removal of one or more blocks 26 leaves a depression or cavity in the pad surface 12, rather than a hole through the pad, the depth of the depression being related to the depth of the cuts 22, 24 delineating the removed block elements.

Figure 5A:
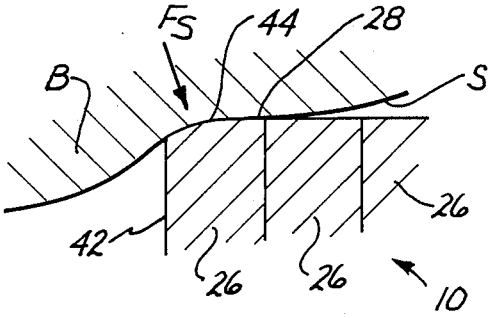
FIG. 5*a* shows in fragmentary elevational view the initial condition of interlinked blocks at the boundary of a hole in the pad.

A problem associated with openings, cavities, recesses and depressions in a support pad of this type is the shear forces to which is subjected the patient's skin and underlying soft tissue at the edge or boundary transition from a planar support surface and the opening or cavity. Such a boundary condition is illustrated in FIG. 5*a* where a user's body B with a skin surface S is supported on a pad such as pad 10 of FIGS. 1–4. FIG. 5*a* is fragmented and only shows a few block elements 26 adjacent a cavity, to illustrate the shear stress on body B at the pad edge 44 adjacent the cavity wall 42. While this shear stress is somewhat relieved by compressive deformation of the block edge 44 to a more rounded configuration, nevertheless, even such a deformed edge presents an area of substantially increased local skin pressure and is consequently undesirable.

Figure 5B:
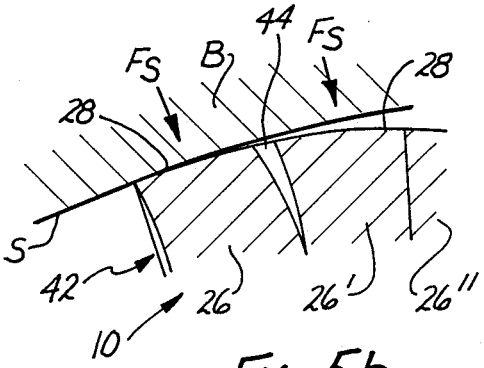
FIG. 5*b* shows how localized adaptative shear stress relief is achieved by individual block elements tearing free of interconnecting linkages to move into stress minimizing position adjacent a recess or opening in the foam pad.

In a interlinked block array such as described in connection with pad 10 of FIGS. 1–4, the foam links 34 may be configured to rupture when predetermined and relatively moderate force is applied to the load bearing surface 28 of any given block 26. Thus, in the situation of FIG. 5*a*, the block 26 adjacent the cavity edge 44 is subject to lateral stress imposed by the body B on its upper surface 28 tending to rotate the top of the block 26 into the cavity 42. Resisting this tendency however, are the linkages 34 (not shown in FIG. 5*a*) which tie the top of the block 26 to the next adjacent block 26. By allowing these linkages 34 to rupture under such shear force, the condition illustrated in FIG. 5*b* is attained. The block 26 adjacent the cavity edge 42 is seen to have rotated into the cavity such that its top surface 28 is perpendicular to the shear force Fs and consequently provides maximal support to the skin S at lowest possible local pressure over the block face 28. It will be readily apparent that pressure against the skin S per unit surface area in the case of the rotated block 26 of FIG. 5*b* is considerably lower than pressure on the skin contacting the compressed edge 44 in FIG. 5*a* where the face 28 of block 26 lies at an angle to the shear force Fs. In FIG. 5*b*, block 26 has torn away along a cleavage 44 from the next adjacent block 26 upon rupture of the interconnecting foam link 34. If sufficient shear force is applied to the next adjacent block 26' then likewise separation of this next block 26' from third block 26'' can be achieved by rupturing its foam linkages 34 away from the third block 26'' in FIG. 5*a*, thereby achieving a reduced shear stress loading of the skin contacting the face 28 of this second block 26'.

The rupture pattern of the foam links 34 over the entire pad surface 12 or any given block array will be unique for any given individual and occurs without particular effort or design on the part of either the patient or attending personnel. It will be apparent therefore that a new degree of adaptability is made possible by interlinking the block elements 26 in the manner shown and described above. Specific dimensions for the foam linkages 34 will depend on the characteristics of the specific foam material selected for the pad 10 as well as on the surface areas 28 of the blocks, and the length and depth of the cuts 22, 24. The necessary numerical data can be readily derived experimentally for particular values of the aforementioned variables. In one pad configuration currently found satisfactory, three block arrys are provided, each preferably extending the full width of the pad 10 and spaced longitudinally on surface 12: a thigh-supporting region consisting of an array of blocks 26 four inches on each side with foam links one-half inch wide on surface 12, the depth of the cut being less than the pad thickness; a buttock to mid-back supporting region consisting of an array of blocks measuring two inches on the side with foam links one-quarter inch wide, the individual cuts 22, 24 defining each block extending fully through the pad thickness, and a foot sipporting region with an array of blocks measuring two inches and otherwise similar to the buttock and mid-back supporting region. The foam material for the pad 10 may be polyurethane foam with an approximate ILD of 26.

Arrays of linked block elements 26 can be readily achieved in mass manufacture by use of cutting dies of a type well known in the industry, and which consist of a large base sheet of plywood or the like on which are supported cutting blades such as sharp edged metal sheets extending vertically from the die into the foam. The uncut foam pads are pressed against the cutting die such that the cutting elements of the die are forced into the foam to effect the cutting in a pattern predetermined by the arrangement of the cutting blades on the die base sheet. By adjusting the height of the cutting blades on the die relative to the foam thickness, it is possible to cut either fully or partially to selected depths into the foam pad. Dies for practicing the invention here disclosed can therefore be readily made by providing individual cutting elements on the die for each cut 22, 24 in the pad thereby defining the interlinked arrays of blocks 26.

While particular embodiments of the invention have been shown and illustrated, it must be understood that many changes, modifications and substitutions to the described embodiments will become readily apparent to those possessed of ordinary skill in the art without thereby departing from the spirit or scope of the present invention which is defined by the following claims.

What is claimed is:

1. In a body support pad of compressible foam having a supporting surface and substantially uniform thickness, the improvement wherein:

at least a portion of said supporting surface is sliced without removal of foam material to a select depth lesser than said thickness in a pattern defining an array of contiguous polygonal blocks each having a load bearing surface and a plurality of corners extending normally to said surface into said pad;

each said block being connected to each other block immediately adjacent thereto by foam links integral with said pad said foam links defined by discontinuous cuts also defining sides of each said polygonal block;

said foam links being adapted and configured to rupture in response to predetermined shear force applied to said load bearing surface relative to any other of said adjacent blocks;

whereby said portion of said supporting surface is characterized by initially uniform load bearing characteristics for each said block but is permanently adaptive to the support requirements of particular users for relieving shear stress on a body resting on said supporting surface by selective rupturing of said foam links.

2. The improvement of claim 1 wherein said blocks and said load bearing surface are rectangular.

3. The improvement of claim 1 wherein said foam links extend into said pad thickness the full depth of said cuts from said supporting surface.

4. The improvement of claim 1 wherein said selective depth is the greater part of said pad thickness so as to allow manual removal of any said block by tearing said foam links and any remaining uncut thickness of said pad interconnecting said block to the remainder of said pad.

5. The improvement of claim 1 wherein said improvement is further characterized in that that area of said load bearing surface of said blocks is smaller in regions of said supporting surface expected to carry heavier load forces, and a the area of said load bearing surface is larger for those blocks in other regions expected to carry relatively smaller load forces imposed by a human body resting thereon.

6. The improvement of claim 5 wherein the tear resistance of said foam links varies inversely to the area of said load bearing surface of each block for different blocks across said pad.

7. The improvement of claim 1 wherein said cutting does not remove a significant volume of foam between adjacent blocks.

8. The improvement of claim 1 wherein said selective depth varies across said supporting surface, said depth being greater for blocks to be more heavily loaded and lesser for blocks to be more lightly loaded by a human body resting on said supporting surface.

9. The improvement of claim 8 wherein said foam links vary in tear resistance inversely to said depth of cut.

10. The improvement of claim 6 or claim 9 wherein said variation in tear resistance is obtained by varying the degree of discontinuity between said discrete cuts defining said foam links.

11. The improvement of claim 1 wherein said foam links vary in tearing strength across said supporting surface.

12. In a body support pad of compressible foam having a supporting surface and substantially uniform thickness, the improvement wherein:

at least a portion of said supporting surface is cut to a select depth lesser than said thickness in a grid pattern defining an array of contiguous rectangular blocks each having a load bearing rectangular surface and a four corners extending normally to said surface into said pad;

each said block being connected to each other block immediately adjacent thereto by foam links integral with said pad;

said pattern comprising discrete cuts defining sides of each said polygonal block, said cuts being discontinuous and defining said foam links;

said foam links being adapted and configured to rupture in response to predetermined shear force applied to said load bearing surface of one block relative to any other of said adjacent blocks;

whereby said portion of said supporting surface is characterized by initially uniform load bearing characteristics for each said block but is permanently adaptive to the support requirements of particular users by selective rupturing of said foam links for relieving shear stress on a body resting on said supporting surface.

13. The improvement of claim 12 wherein said foam pad has opposite head and foot ends normally associated respectively with those portions of a human body resting on said supporting surface, the improvement further characterized in that the shear relief characteristics of said portion are adapted to the anticipated local loading of said supporting surface by different anatomical features of the resting human body.

14. The improvement of claim 13 wherein:

said load bearing surface of said blocks is smaller in at least one region of said supporting surface expected to carry heavier load forces, and a larger surface area for those blocks outside said least one region expected to carry relatively smaller load forces imposed by a human body resting thereon; and wherein said foam links vary in tear resistance across said supporting surface, said variation in tear resistance being obtained at least in part by varying the degree of discontinuity between said discrete cuts defining said foam links.

15. The improvement of claim 13 or claim 14 characterized in that said cutting extends to a sufficient depth in said pad thickness to allow manual removal of at least some of said blocks by tearing of any remaining interconnecting foam.

* * * * *